US008845497B2

(12) United States Patent
Turner

(10) Patent No.: US 8,845,497 B2
(45) Date of Patent: Sep. 30, 2014

(54) EXERCISE MACHINE FOR PROVIDING RESISTANCE TO AMBULATORY MOTION OF THE USER

(76) Inventor: Joseph Turner, San Antonio, TX (US)

( * ) Notice: Subject to any disclaimer, the term of this patent is extended or adjusted under 35 U.S.C. 154(b) by 787 days.

(21) Appl. No.: 12/764,074

(22) Filed: Apr. 20, 2010

(65) Prior Publication Data

US 2010/0298104 A1 Nov. 25, 2010

Related U.S. Application Data

(60) Provisional application No. 61/214,078, filed on Apr. 20, 2009.

(51) Int. Cl.

| | |
|---|---|
| ***A63B 21/015*** | (2006.01) |
| ***A63B 23/04*** | (2006.01) |
| ***A63B 21/00*** | (2006.01) |
| ***A63B 21/06*** | (2006.01) |
| *A63B 71/02* | (2006.01) |
| *A63B 21/22* | (2006.01) |

(52) U.S. Cl.

CPC ..... *A63B 71/02* (2013.01); *A63B 23/047* (2013.01); *A63B 21/00069* (2013.01); *A63B 2071/025* (2013.01); *A63B 21/0618* (2013.01); *A63B 21/153* (2013.01); *A63B 23/0405* (2013.01); *A63B 21/1415* (2013.01); *A63B 2208/0204* (2013.01); *A63B 21/225* (2013.01); *A63B 21/015* (2013.01)

USPC ..... 482/93; 482/115; 482/127

(58) Field of Classification Search

USPC ..... 482/51, 52, 110, 142, 148, 93, 115, 482/127, 72

See application file for complete search history.

(56) References Cited

U.S. PATENT DOCUMENTS

| | | | |
|---|---|---|---|
| 629,655 | A | 7/1899 | Bryon |
| 3,519,269 | A | 7/1970 | Howlett et al. |

(Continued)

*Primary Examiner* — Stephen Crow

(74) *Attorney, Agent, or Firm* — Kammer Browning PLLC

(57) ABSTRACT

An exercise machine that provides a generally consistent resistive force against a user who walks, steps, or runs away from the machine as part of a strength training exercise program. The machine is built upon a movable frame having transport wheel assemblies that allow the exercise machine to be placed on an indoor floor surface or on the ground outdoors. The frame of the device further supports three parallel spinning assemblies that together allow a length of linear strap attached to the user to run out from the machine and thereafter be retracted or rewound back into the machine. The spinning assemblies include a flywheel assembly, a spool assembly, and a spring assembly, each co-axially arranged on a spin axle extending across the frame. The spring assembly is fixed against the frame and incorporates a coil spring that tightens with the rotation of the spin axle in a first direction (allowing the linear run-out strap to extend out from the spool assembly). The coil spring in the spring assembly thereafter tends to direct the rewinding of the strap back onto the spool assembly. The coaxial flywheel assembly provides both an initial stationary inertia and a subsequent rotational inertia. The flywheel acts as a governor to balance the changing forces associated with the resistive force increasing in the spring assembly. Positioned on the spin axle between the flywheel assembly and the spring assembly is a spool assembly that allows the strap to unwind and subsequently to be wound back onto the spool. A guide strap may be provided around the spool to maintain the linear run-out strap within the spool assembly. A resistance adjustment assembly presses a brake pad against the perimeter surface of the flywheel to adjust the force required to direct rotation of the system. A weight horn bracket is provided to add additional disc weights if necessary.

12 Claims, 6 Drawing Sheets

(56) References Cited

U.S. PATENT DOCUMENTS

| | | | | |
|---|---|---|---|---|
| 3,972,238 | A | 8/1976 | Thatcher | |
| 4,077,626 | A * | 3/1978 | Newman | 482/110 |
| 4,135,714 | A * | 1/1979 | Hughes | 482/127 |
| 4,468,026 | A | 8/1984 | Roark | |
| 4,625,962 | A * | 12/1986 | Street | 482/116 |
| 4,822,032 | A | 4/1989 | Whitmore et al. | |
| 4,830,365 | A | 5/1989 | March | |
| 4,984,986 | A | 1/1991 | Vohnout | |
| 5,242,351 | A | 9/1993 | Berg et al. | |
| 5,466,203 | A | 11/1995 | Chen | |
| 5,569,138 | A | 10/1996 | Wang et al. | |
| 5,586,624 | A | 12/1996 | Ko et al. | |
| 5,613,926 | A | 3/1997 | Michaelson | |
| 6,027,429 | A | 2/2000 | Daniels | |
| 6,071,215 | A | 6/2000 | Raffo et al. | |
| 6,302,829 | B1 * | 10/2001 | Schmidt | 482/70 |
| 6,413,196 | B1 * | 7/2002 | Crowson | 482/118 |
| 6,599,223 | B2 | 7/2003 | Wang et al. | |
| 6,631,866 | B1 * | 10/2003 | Obrink et al. | 242/390.8 |
| 6,634,998 | B2 * | 10/2003 | Siaperas | 482/142 |
| 6,685,602 | B2 * | 2/2004 | Colosky et al. | 482/127 |
| 6,811,520 | B2 | 11/2004 | Wu et al. | |
| 6,835,167 | B2 * | 12/2004 | Schmidt | 482/70 |
| 6,857,993 | B2 | 2/2005 | Yeh | |
| 6,929,587 | B2 * | 8/2005 | Charnitski | 482/110 |
| 7,048,638 | B2 * | 5/2006 | Novotny | 473/219 |
| 7,052,440 | B2 | 5/2006 | Pyles et al. | |
| 7,169,093 | B2 | 1/2007 | Simonson et al. | |
| 7,192,390 | B2 * | 3/2007 | Berard | 482/126 |
| D552,193 | S | 10/2007 | Husted et al. | |
| 7,282,016 | B2 | 10/2007 | Simonson | |
| 7,322,905 | B2 * | 1/2008 | Morris | 482/74 |
| 7,462,141 | B1 | 12/2008 | Raboin et al. | |
| 7,637,853 | B2 * | 12/2009 | Crowson et al. | 482/127 |
| 7,641,597 | B2 * | 1/2010 | Schmidt | 482/51 |
| 7,699,724 | B1 * | 4/2010 | Derisse | 473/451 |
| 7,871,359 | B2 * | 1/2011 | Humble et al. | 482/127 |
| 7,878,955 | B1 * | 2/2011 | Ehrlich et al. | 482/127 |
| 7,922,635 | B2 * | 4/2011 | Lull et al. | 482/142 |
| 8,002,677 | B2 * | 8/2011 | Dibble et al. | 482/92 |
| 8,328,700 | B2 * | 12/2012 | Humble et al. | 482/127 |
| 2002/0025891 | A1 | 2/2002 | Kolosky, Jr. et al. | |
| 2007/0243979 | A1 | 10/2007 | Hand | |
| 2007/0287601 | A1 | 12/2007 | Burck et al. | |

* cited by examiner

EXERCISE MACHINE FOR PROVIDING RESISTANCE TO AMBULATORY MOTION OF THE USER

CROSS REFERENCES TO RELATED APPLICATIONS

This application claims the benefit under Title 35 United States Code §119(e) of U.S. Provisional Application 61/214,078 filed Apr. 20, 2009 the full disclosure of which is incorporated herein by reference.

BACKGROUND OF THE INVENTION

1. Field of the Invention

The present invention relates generally to exercise machines and systems for providing resistive force exercise to the user. The present invention relates more specifically to an exercise machine structured to provide a consistent force resisting the ambulatory (walking and/or running) motion of a user moving away from and then back towards the machine.

2. Description of the Related Art

Many exercise regimens call for the repeated movement of the exercising individual from a first point to a second point, typically across a gym floor or across an outdoor field. In some cases this movement is simply a straight line run from one point to the next. In some cases the movement involves weaving around cones or other small obstacles in the path. Some efforts have been made in the past to increase the strength and/or energy required to make this movement by securing a weight to the exercising individual that must be pulled along during the exercise. One such effort in the past has been to provide a weight sled that may be connected to the exercising individual by a line (a cord or a rope) and is drug along the ground by the individual as they attempt to run. Clearly the process of dragging such a weight sled across a floor surface indoors can be problematic.

Even when used outdoors, the typical weight sled offers a very inconsistent resistive force to the user and often results in intervals of high resistance (where the sled sticks or digs into the ground) followed by intervals of very little resistance (where the sled looses contact with the ground and jumps a distance).

A further effort in the past to provide additional resistive force to an exercising individual replaces the sliding weight sled with a fixed but stretchable "bungee cord" line attached to a fixed anchor and to a harness on the individual. Rather than provide a consistent resistive force, however, such systems provide an initial weak force that gradually increases to very strong force. This often results in the individual being awkwardly jerked backwards at the end of the exercise motion. Many injuries have resulted from the use of both types of resistance exercise systems.

It would be desirable to provide a resistance exercise system that could be easily used indoors or outdoors without concern for damaging the indoor floor surface or the outdoor turf. It would be desirable if the system provided a generally consistent resistive force rather than one that dramatically increased during the exercise or one that provided a resistive force in jerking catches and releases. It would further be desirable if such a system provided a gradual but consistent recoil at the end of the exercise so as to allow the user to return casually to the starting point of the exercise to complete the workout or to start the exercise again.

It would further be desirable to provide a mechanism for adjusting the resistive force exerted against the user during the exercise and to provide an easy and accurate means for indicating the level of the resistive force. It would be beneficial if the resistive force exercise device were capable of easily resetting itself without tangling or damaging the line attached between the device and the user.

SUMMARY OF THE INVENTION

In fulfillment of the above and other objectives, the present invention provides an exercise machine that establishes a generally consistent resistive force against a user who walks, steps, or runs away from the machine as part of a strength training exercise program. The machine is built upon a movable frame having transport wheel assemblies that allow the exercise machine to be place on a floor surface indoors or on the ground outdoors. The frame of the device further supports three parallel spinning assemblies that together allow a linear strap attached to the user to run out from the machine and to thereafter be retracted or rewound back into the machine.

The spinning assemblies include a flywheel assembly, a spool assembly, and a spring assembly, each co-axially arranged on a spin axle extending across the frame. The spring assembly is fixed against the frame and incorporates a coil spring that tightens with the rotation of the spin axle in a first direction (allowing a linear run-out strap to extend from the spool assembly). The coil spring in the spring assembly thereafter tends to direct the rewinding of the linear run-out strap back onto the spool assembly when the extractive force exerted by the user is released.

The flywheel assembly positioned opposite the spring assembly across the spool assembly provides both an initial stationary inertia that the user must overcome in order to initiate rotation of the assemblies, and a rotating inertia once the system is in rotational motion. The flywheel acts as a governor to balance the changing forces associated with the spring assembly as the coil spring therein tightens and subsequently loosens. Positioned on the spin axle between the flywheel assembly and the spring assembly is a spool assembly which allows the linear run-out strap to unwind and subsequently to be wound back again on the spool.

A guide strap around the spool helps position and maintains the linear run-out strap within the spool assembly during retraction and extension. A resistance adjustment assembly presses a brake pad against a perimeter surface of the flywheel to allow the user to adjust the force that is required to initiate rotation of the system. An additional weight horn bracket is positioned on the rear of the frame to add additional disc weights to the device if necessary.

Further objectives of the present invention will become apparent from an understanding of the following detailed description and the attached drawing figures which may be briefly described as follows.

DETAILED DESCRIPTION OF THE PREFERRED EMBODIMENTS

Figure 1:
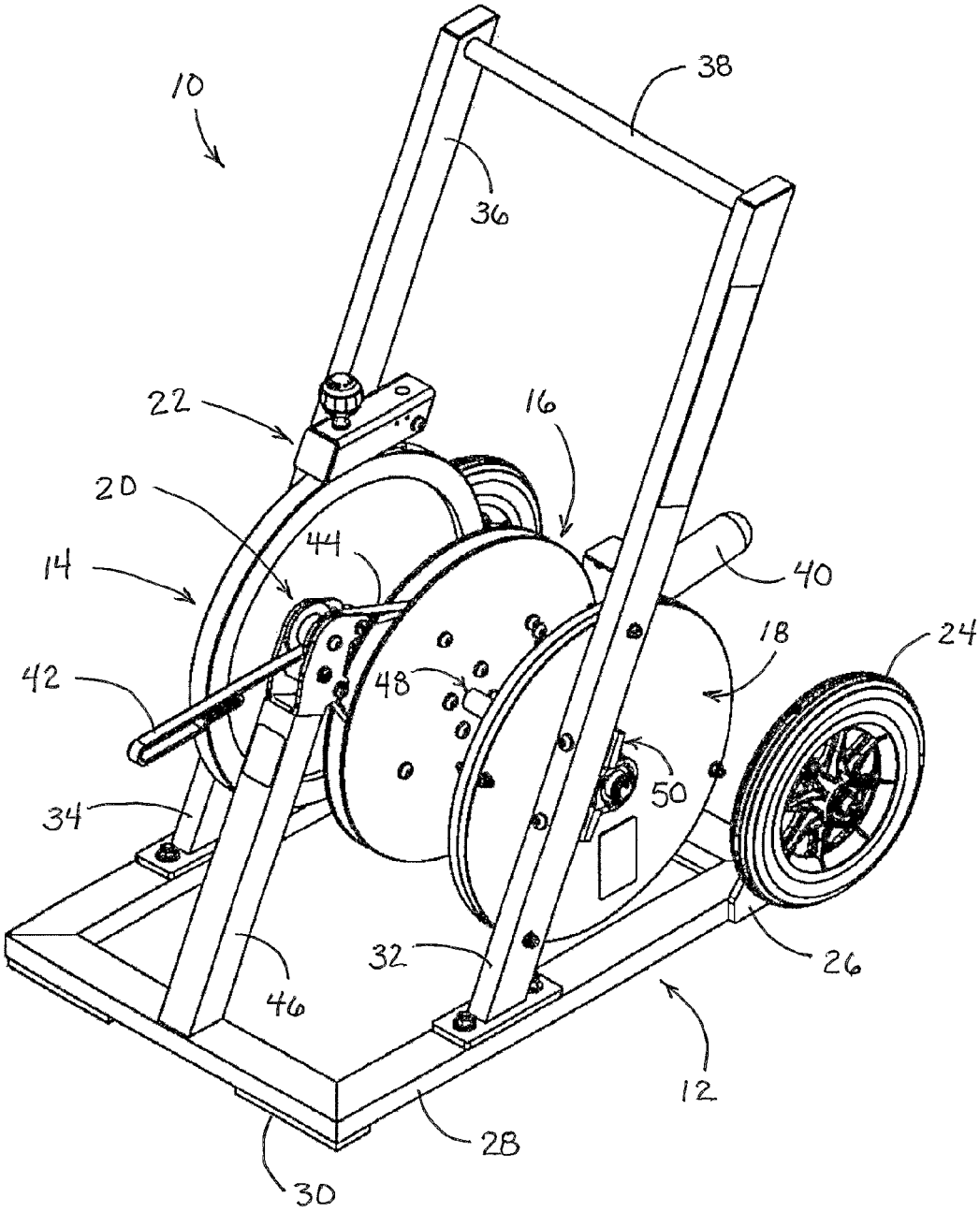
FIG. 1 is a perspective view of the exercise machine system of the present invention.

Reference is made first to FIG. 1 for a description of the overall system of the present invention. As indicated above, the exercise machine system of the present invention is intended to provide a means for exercising by subjecting oneself to a resistive force while stepping, walking, or running away from a fixed point. Exercise machine 10 of the present invention is comprised of a number of individual assemblies. Exercise machine 10 may be seen to comprise frame assembly 12 which incorporates and supports fly wheel assembly 14, spool assembly 16, and spring assembly 18. The manner in which these assemblies interact is described in more detail below.

A number of additional smaller assemblies are also included in the overall exercise machine system 10 of the present invention. These smaller assemblies, which are mounted at various places on frame assembly 12, include lead guide rollers assembly 20 and resistance adjustment assembly (brake assembly) 22. The structures of these two attachment assemblies are also described in more detail below.

Also positioned on frame assembly 12 are transport wheels 24, each mounted to transport wheel brackets 26. Transport wheel brackets 26 are welded or bolted to frame base 28 of frame assembly 12. Positioned on an underside of frame base 28 are base gripper pads 30. Extending up from frame base 28 are left frame arm 32 and right frame arm 34. These two frame arms 32 and 34 extend upward (to support the rotating assemblies described in more detail below) into upper frame 36 which terminates in transport handle 38.

Positioned on a rear facing side of frame base 28 of frame assembly 12 is weight horn assembly 40 which, in the preferred embodiment, is sized and structured to receive additional weights to provide further resistance to the unintended lateral movement of exercise machine 10.

Two separate straps are provided in the system of the present invention to effect the functionality of the device. Linear run-out strap 42 is the component that is attached to the individual (by means of a harness and clip) at one end (a first loose end) and that is wound on spool assembly 16 at the opposite end. Linear run-out strap 42 is unwound as the user moves outward from the front of exercise machine 10. A second guide strap 44 is positioned in a short loop around the spool assembly, covering and partially enclosing the linear run-out strap 42. The manner in which guide strap 44 helps retain linear run-out strap 42 in a correct position and orientation on spool assembly 16 is described in more detail below.

Lead guide rollers assembly 20 is supported in an appropriate position adjacent spool assembly 16 by way of guide roller support arm 46 which is mounted on frame base 28 of frame assembly 12. Structured as described above, exercise machine system 10 of the present invention is capable of functioning to provide a variable resistance backward force that the user runs against or otherwise moves against in the process of exercising.

The manner of using exercise machine system 10 of the present invention is now described again primarily with reference to FIG. 1. Exercise machine system 10 may be moved to an appropriate position, either indoors or outdoors, with the overall weight of the device typically providing sufficient frictional force with the floor or ground surface to prevent its lateral motion during use. Additional weight may be added to exercise machine system 10 by the placement of typical disc weights (such as may be utilized on a barbell) onto weight horn assembly 40. This assembly (shown in clearer detail in FIG. 2) is sized to receive the standard Olympic sized weight discs and to be retained thereon utilizing standard Olympic bar spring clips. The type of surface the device will be used on will typically determine whether addition weight will be required to hold it in place.

The exercise machine system 10 of the present invention may be moved to the appropriate placement position by grasping transport handle 38 and tilting the entire machine backwards onto transport wheels 24. Transport wheels 24 are positioned such that when the machine is tilted back the wheels come into contact with the floor or ground and allow for the easy transport of the device. When the proper placement is achieved, the device is then tilted forward such that transport wheels 24 no longer make contact with the floor or ground surface. Once in position and once any additional weight has been placed on weight horn assembly 40 the user then retrieves the end of linear run-out strap 42 and clips this end onto a harness generally worn about the shoulders and chest. This harness is preferably reversible and may be typically connected such that the clip-in point is on the back of the user, which allows the user to run forward away from the front of the exercise machine. In other exercise environments the user may choose to clip into linear run-out strap 42 on the front of the harness such that the user would move backwards from the machine to exercise different sets of muscles.

Once clipped in, the user may then choose to adjust the resistance that the machine will provide to the user during run out. Resistance adjustment assembly 22, alternately referred to as a brake assembly, is fixed to the interior side of upper frame 36 in a position that allows it to come into spring loaded contact with flywheel assembly 14. A knob adjustment increases or decreases the force exerted by resistance adjustment assembly 22 onto the peripheral surface of flywheel assembly 14. In a preferred embodiment of the present invention a digital readout provides an indication of the force that has been dialed in by a particular user. The details of the structure of this alternate embodiment are shown below with respect to FIG. 5.

Once clipped in to linear run-out strap 42 the user may then run or walk either forward or backward away from the front of exercise machine system 10 in a manner that allows the user to benefit from the retractive force generated by the exercise machine. This retractive force is a combination of the inertia provided initially by flywheel assembly 14 which generally resists the rotational motion of the assembly and thereby initially resists the unwinding of the linear run-out strap 42 from spool assembly 16. In addition to the inertia provided by the heavy flywheel assembly 14, spring assembly 18 comes into play the further the user is removed from the exercise machine 10. As the user extracts the linear run-out strap 42, spring assembly 18 begins providing greater resistance to this unwinding effort.

Spring assembly 18, as described in more detail below, includes a coil spring that, as the spinning assemblies of the exercise machine rotate in a manner directed by the movement of the user away from the machine, is coiled tighter within a fixed housing. One of the benefits of the present invention, however, is the fact that as the user initiates the rotation of the spinning assemblies of the present invention, the flywheel component, which initially provides an inertial resistance to rotational motion, begins to provide assistance to such rotational motion once it is rotating with some velocity. In contrast, spring assembly 18 provides generally little resistance initially, but as the spring within spring assembly 18 is wound tighter, the resistance force increases. These two resistive forces (which are changing in opposite directions) counter-balance each other in the process of rotation such that a generally consistent resistive force is experienced by the user. That is, initially the user is working primarily against the inertial resistive force required to begin spinning the flywheel assembly 14 experiencing less resistive force from spring assembly 18. Once moving, however, flywheel assembly 14 actually assists in the rotational movement and the motion outward by the user. As the spring in spring assembly 18 is wound tighter, it correspondingly provides a greater resistive force.

When the user has run the extent of linear run-out strap 42 (typically 40 yards in the preferred embodiment of the present invention) the user stops and then returns to the exercise machine 10 for further exercise or to disconnect. The process of returning to the machine directs a re-coiling or rewinding of linear run-out strap 42 as a result of the counter-rotation directed by the now tightly wound spring within spring assembly 18. As with the run-out with the strap, the return winding of the strap is likewise regulated in its speed by way of the interactive effects between flywheel assembly 14 and spring assembly 18. Because flywheel assembly 14 provides an inertial force counter to the tendency of spring assembly 18 to rotate and re-wind linear run-out strap 42, the process of rewinding is carried out at a moderate rate rather than with any sudden jerking motions or with any great force. The combination of the rotating assemblies therefore acts as a governor to the speed with which the rotating assemblies turn all the while providing a relatively constant resistive force to the user during run-out and a constant retraction force during the rewinding return.

Figure 2:
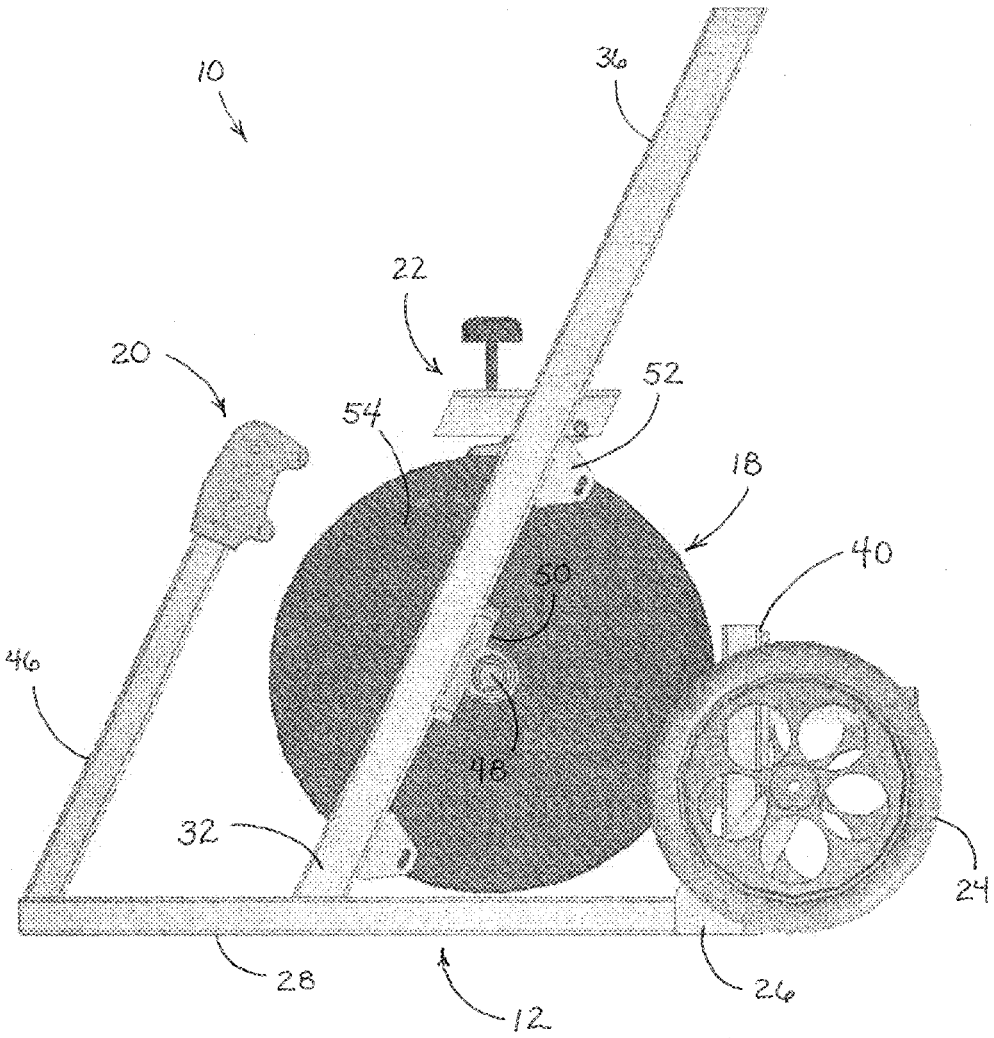
FIG. 2 is a side elevational view of the exercise machine system of the present invention as it might be positioned on a flat indoor floor surface or an outdoor ground surface.

Reference is now made to FIG. 2 for a further detailed description of the components of the exercise machine system 10 of the present invention. FIG. 2 is a side elevational view of the components situated on the left hand side of the device (as viewed from behind the device, such as when holding onto the transport handle). From this side view, spring assembly 18 can be seen in profile and the manner in which it is attached to upper frame 36 at left frame arm 32 is also disclosed. Spring assembly 18 is attached to left frame arm 32 at two spring assembly brackets 52. Brackets 52 receive bolts extending from spring assembly enclosure 54. Spin axle 48 is seen on end extending out of the center of spring assembly 18. Spin axle 48 is retained within axle bearing 50 which is bolted to left frame arm 32 as shown. A similar bearing structure is provided on the opposite side of the frame.

Also seen in FIG. 2 is guide roller support arm 46 which elevates and supports lead guide rollers assembly 20. Linear run-out strap 42 and guide strap 44 are omitted in FIG. 2 for clarity. Also positioned on frame assembly 12 extending above frame base 28 are transport wheel brackets 26 (one on each side) which each support a transport wheel 24. Seen between transport wheels 24 is weight horn assembly 40. Finally seen in FIG. 2 is resistance adjustment assembly 22 with a brake pad shown in contact with flywheel assembly 14 (not seen in the view from this side of the device).

Figure 3:
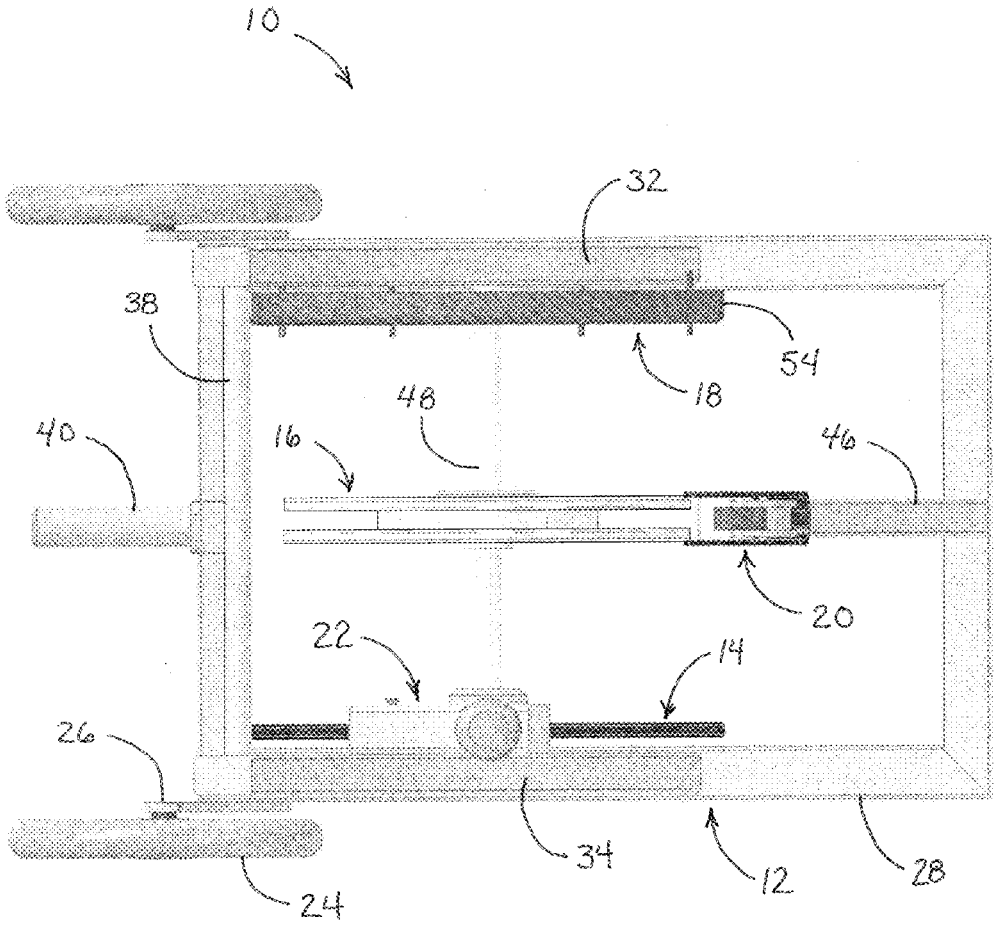
FIG. 3 is a top plan view of the exercise machine system of the present invention.

FIG. 3 provides a top plan view of the exercise machine system of the present invention showing in greater detail the three spinning assemblies that make up the primary functional components of the system. In FIG. 3 frame assembly 12 is seen to include frame base 28 as well as left frame arm 32 and right frame arm 34 which extend up to position and retain transport handle 32. Weight horn assembly 40 is seen positioned on the rear side of frame assembly 12. Transport wheel brackets 26 are positioned on each side of frame assembly 12 and support each of the two transport wheels 24.

Spin axle 48 is shown to extend across frame assembly 12 and thereby positions and supports each of the three spinning assemblies including flywheel assembly 14, spool assembly 16, and spring assembly 18. Lead guide rollers assembly 20 is shown positioned at the end of guide roller support arm 46 which extends up from frame base 28. Here again, linear run-out strap 42 and guide strap 44 are omitted for clarity. The internal structure of spool assembly 16 can better be seen in this view of FIG. 3.

Figure 4:
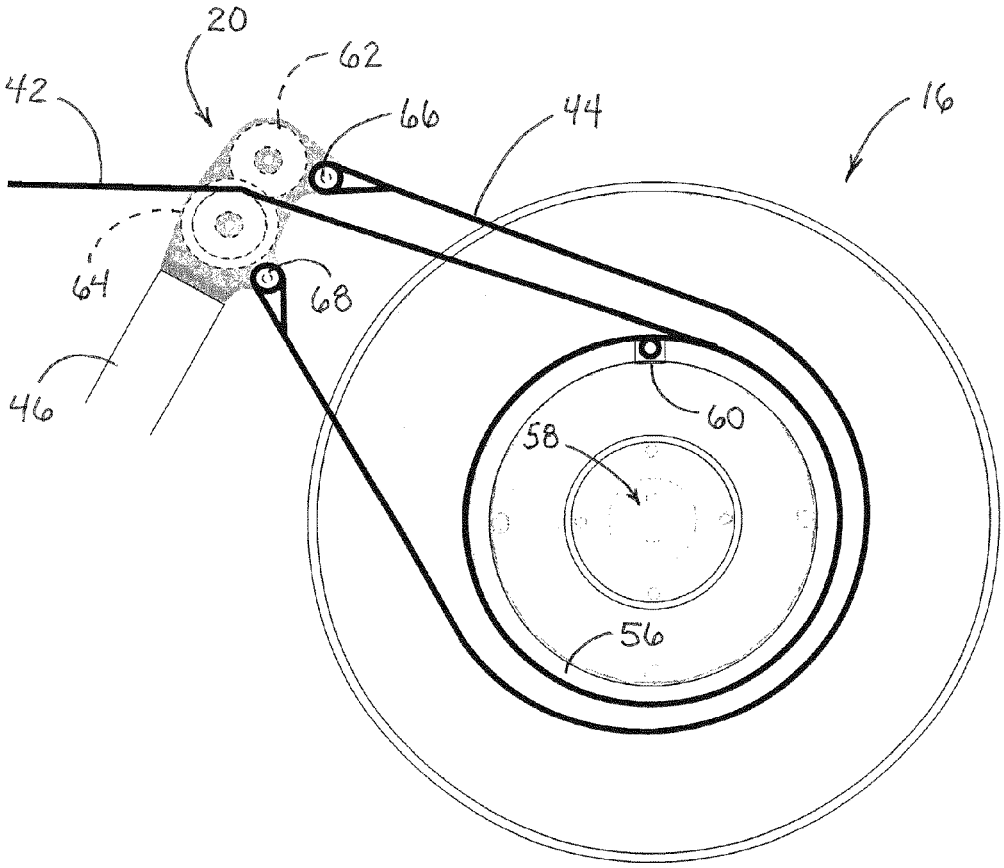
FIG. 4 is a detailed side view of the spool assembly and the guide roller assembly of the exercise machine system of the present invention showing the placement and routing of the straps.

Reference is now made to FIG. 4 which is a detailed view of spool assembly 16 and lead guide rollers assembly 20. In this partially schematic view, the manner in which linear run-out strap 42 and guide strap 44 are retained on and positioned in conjunction with spool assembly 16 is shown. Spool assembly 16 is comprised of two parallel discs separated by a center drum 56. The assembly is positioned on spin axle 48 (not shown) by way of keyed center aperture 58.

At one point on the wall that forms drum 56 is a slot 60 suitable for insertion of a fixed end of linear run-out strap 42 which retains a looped end section that may be retained by a pin positioned through the spool assembly. In this manner, a fixed end of linear run-out strap 42 is retained on drum 56 and may thereafter be wound by way of the rotation of spool assembly 16. The opposite end of linear run-out strap 42 extends from the surface of the drum (that is, from the surface of the extent to which the strap is wound about the drum 56) and between the rollers positioned within lead guide rollers assembly 20. Top roller 62 is approximately as wide as linear run-out strap 42 while bottom roller 64 contains a peripheral channel within which linear run-out strap 42 is held. In this manner, the combination of top roller 62 and bottom roller 64 serve to move linear run-out strap 42 in and out of spool assembly 16 in a flat orientation suitable for winding about spool assembly 16. Therefore whether the linear run-out strap 42 is being drawn back into the system or is being pulled out from the system, the roller assembly serves to straighten the strap into a preferable orientation.

Also included in lead guide rollers assembly 20 are guide strap retention pins 66 and 68. Guide strap 44 is a short section of strap similar in width dimension to linear run-out strap 42. The purpose of guide strap 44 is to facilitate the organized rewinding of linear run-out strap 42 onto spool assembly 16. By riding loosely around drum 56 of spool assembly 16, guide strap 44 serves to prevent the bunching or entanglement of linear run-out strap 42, primarily as it is returned into spool assembly 16 during the process of rewinding. Linear run-out strap 42 could have a tendency to extend outside of the parallel discs that make up spool assembly 16 if it were not for the closure of the same by guide strap 44.

Figure 5:
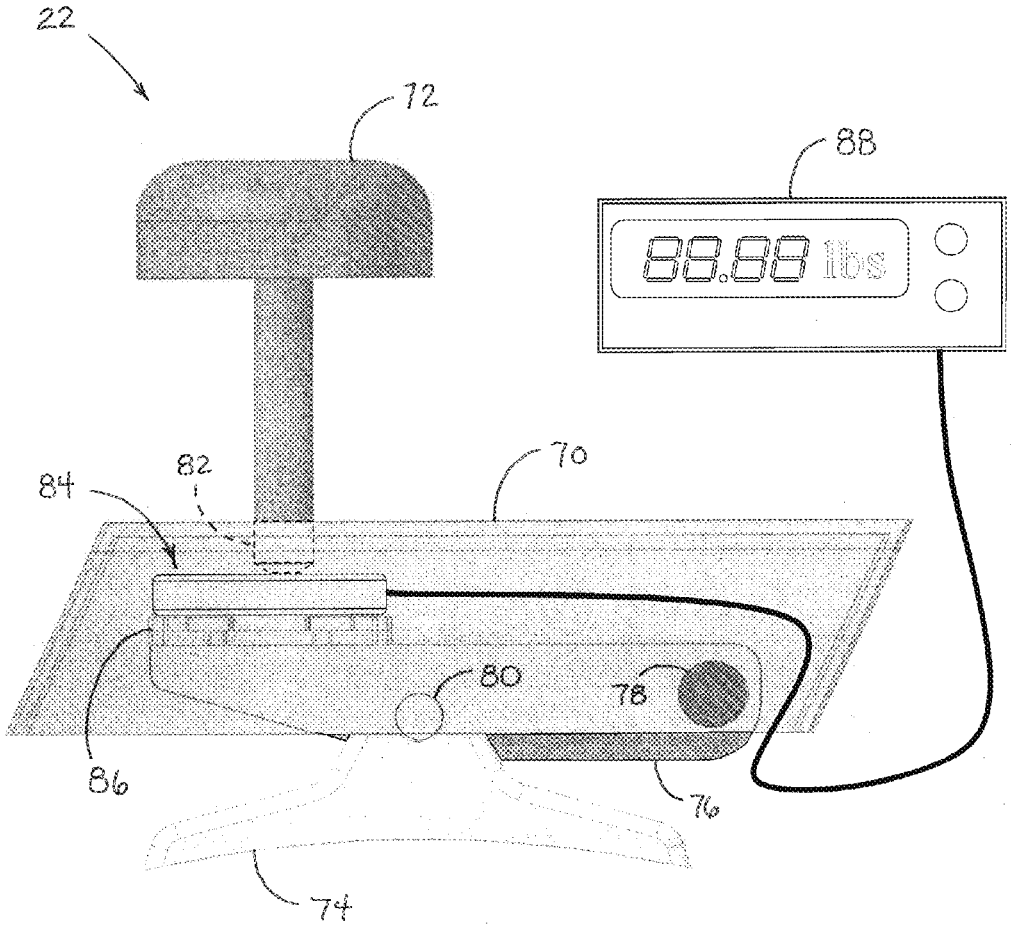
FIG. 5 is a detailed perspective view of the brake assembly (resistance adjustment assembly) of the exercise machine system of the present invention.

Reference is now made to FIG. 5 for a detailed description of the resistance adjustment assembly 22 comprising a resistance braking mechanism for adjusting the resistive force exerted by the system of the present invention. Resistance adjustment assembly 22 comprises a housing 70 enclosing a pivoting brake arm 76 that pivotally retains brake pad 74. Brake pad 74 is curved on an underside surface so as to follow the contours of the perimeter surface of flywheel assembly 14. Housing 70 is rigidly mounted to the upper frame 36, and more specifically to right frame arm 34 as shown in FIG. 1. Bolt 78 holds housing 70 to the frame of the machine, while also providing a pivot axle for brake lever arm 76. In this manner, brake pad 74, which in turn pivots on pin 80 extending through brake lever arm 76, may ride on the peripheral surface of flywheel assembly 14.

Adjustments to the pressure with which the brake pad 74 is forced against flywheel assembly 14 are made with adjustment knob 72 which extends through housing 70 with a threaded aperture and threaded end section 82. This threaded adjustment mechanism allows the user to turn knob 72 and direct pressure against the brake spacing components situated on top of brake lever arm 76. Included among the spacing components compressed between brake lever arm 76 and adjustment knob 72 are brake component retention pads 76 which, in a first embodiment may simply fill the space between brake lever arm 76 and adjustment knob shaft 72. In an alternate embodiment, load cell 84 may be positioned between brake spacer components 86 and adjustable knob 72 so as to measure the force exerted between the movable brake lever arm 76 and the fixed housing 70. In this manner, digital display 88 may be positioned on a handle portion on the upper frame 36 of exercise machine 10 in order to provide the user with a digital readout of the force that has been set as a resistance force against the flywheel.

Figure 6:
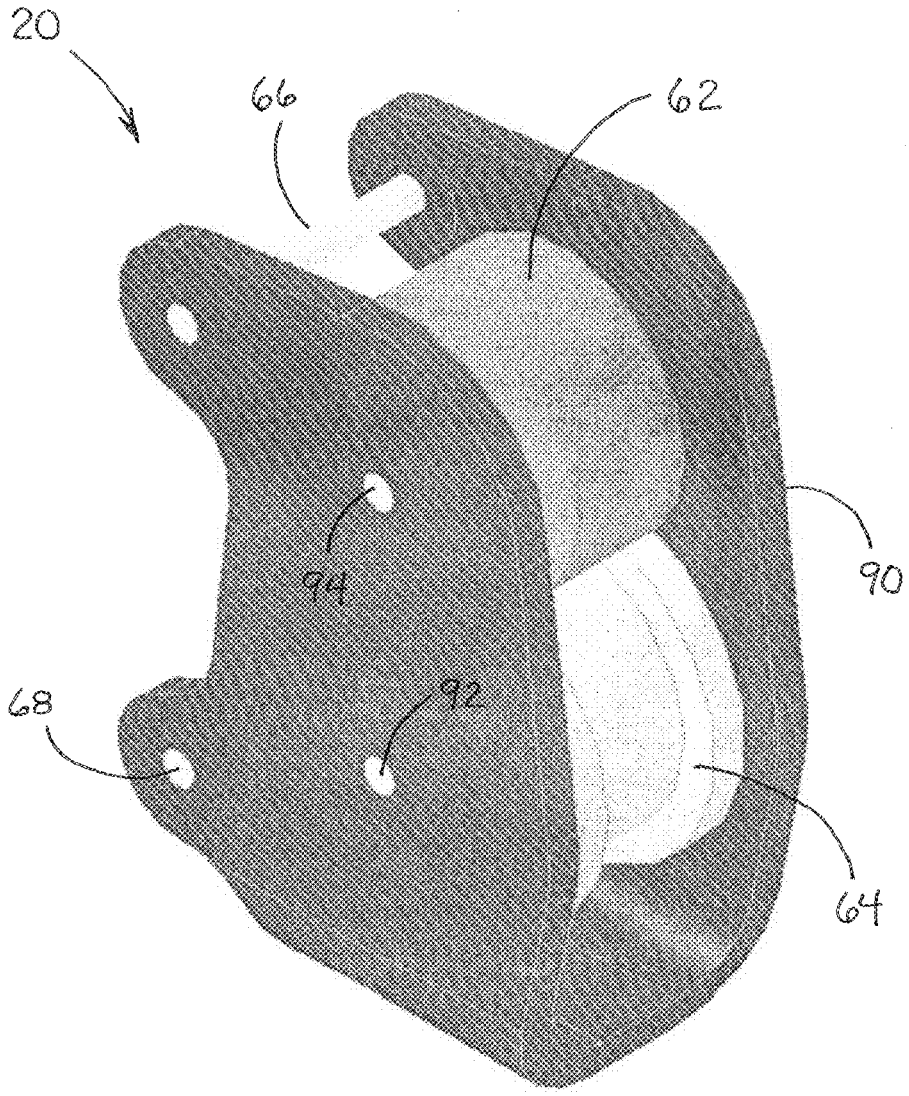
FIG. 6 is a detailed perspective view of the lead guide rollers assembly of the exercise machine system of the present invention.

Reference is finally made to FIG. 6 for a detailed description of the lead guide rollers assembly and the manner in which the linear run-out strap 42 (not shown in FIG. 6) and guide strap 44 (also not shown in FIG. 6) are fed through the rollers to provide optimum winding and unwinding of the system. Lead guide rollers assembly 20 is constructed of a U-shaped plate frame that is attached to guide roller support arm 46 as shown in FIG. 1. Between the parallel faces of frame 90 are positioned top roller 62 and bottom roller 64. As described above, top roller 62 is approximately the width of the linear run-out strap while bottom roller 64 comprises a recessed channel that is also approximately the width of the linear run-out strap. In this manner, the linear run-out strap is held between the rim edges of bottom roller 64 and is pressed into the recessed channel therein by top roller 62. Linear run-out strap 42 may then simply fed in either direction between the two rollers. Top roller 62 is held within the frame 90 by way of axle pins 94 while bottom roller 64 is held within frame 90 by way of axle pin 92.

In addition to the two rollers described above, frame 90 retains two further retention pins designed to hold the looped ends of guide strap 44. Retention pin 66 holds a first end of guide strap 44 that extends over the top of spool assembly 16 (not shown). Retention pin 68 holds the opposite looped end of guide strap 44 after it passes behind and below spool assembly 16, again as shown in FIG. 1. In this manner, guide strap 44 presents a nearly closed loop around spool assembly 16 with the only point of exit being between rollers 62 and 64 for linear run-out strap 42. With this structure, guide rollers assembly 20 helps to accurately and cleanly feed and retract the linear run-out strap of the exercise device of the present invention.

Although the present invention has been described in terms of the foregoing preferred embodiments, this description has been provided by way of explanation only, and is not intended to be construed as a limitation of the invention. Those skilled in the art will recognize modifications in the present invention that might accommodate specific exercise regimen requirements and limitations. Such modifications as to structure, size, and even the specific arrangement of components, where such modifications are coincidental to the exercise environment or the specific workout regimen being pursued, do not necessarily depart from the spirit and scope of the invention.

I claim:

1. A self-powered exercise apparatus for providing a resistive force against the ambulatory motion of a user, the exercise apparatus comprising:

(a) a support frame;

(b) a rotatable shaft supported and fixed to the frame at one or more rotation bearings;

(c) a spool assembly having a center fixed on the rotatable shaft and comprising a winding drum;

(d) a length of lead line windable on the spool assembly, the length of lead line sufficient to allow the user to engage in said ambulatory motion for a plurality of strides away from the spool assembly;

(e) a flywheel assembly having a center fixed on the rotatable shaft, the flywheel assembly having a flywheel rotatable in conjunction with the rotatable shaft, and wherein drawing the length of lead line out from being wound on the spool assembly directs a first rotational motion of the rotatable shaft and the flywheel assembly; and (f) a resistance adjustment assembly in sliding frictional contact with a perimeter rim of the flywheel, the resistance adjustment assembly fixed on the support frame adjacent the flywheel assembly, the resistance adjustment assembly comprising:

an adjustment knob having a movable contact point;

a brake lever arm in contact with the movable contact point on the adjustment knob; and a brake pad pivotally positioned on the brake lever arm and oriented for contact with the flywheel;

wherein drawing the length of lead line out from being wound on the spool assembly directs a first rotational motion of the rotatable shaft, and wherein releasing the length of lead line drawn out from the spool assembly allows for a second rotational motion opposite the first in a manner that rewinds the length of lead line on the spool assembly.

2. The apparatus of claim 1 further comprising:

a force transducer positioned between the movable contact point of the adjustment knob and the brake lever arm; and a display device connected to the force transducer for displaying an indication of the degree of force exerted by the resistance adjustment assembly on the flywheel assembly.

3. The apparatus of claim 1 further comprising a guide roller assembly positioned on the support frame for guiding the length of lead line out from and in to the spool assembly.

4. The apparatus of claim 3 wherein the guide roller assembly comprises at least two rollers positioned to retain the length of lead line between them while permitting the length of lead line to move lengthwise through the guide roller assembly.

5. A self-powered exercise apparatus for providing a resistive force against the ambulatory motion of a user, the exercise apparatus comprising:

(a) a support frame;

(b) a rotatable shaft supported and fixed to the frame at one or more rotation bearings;

(c) a spool assembly having a center fixed on the rotatable shaft and comprising a winding drum and a guide strap positioned around the winding drum at least partially enclosing the length of lead line when the length of lead line is wound on the spool assembly; and (d) a length of lead line windable on the spool assembly, the length of lead line sufficient to allow the user to engage in said ambulatory motion for a plurality of strides away from the spool assembly;

wherein drawing the length of lead line out from being wound on the spool assembly directs a first rotational motion of the rotatable shaft, and wherein releasing the length of lead line drawn out from the spool assembly allows for a second rotational motion opposite the first in a manner that rewinds the length of lead line on the spool assembly.

6. The apparatus of claim 5 further comprising a guide roller assembly positioned on the support frame for guiding the length of lead line out from and in to the spool assembly and for retaining the ends of the guide strap.

7. The apparatus of claim 6 wherein the guide roller assembly comprises at least two rollers positioned to retain the length of lead line between them while permitting the length of lead line to move lengthwise through the guide roller assembly and at least two retention pins to retain the ends of the guide strap.

8. A self-powered exercise apparatus for providing a resistive force against the ambulatory motion of a user, the exercise apparatus comprising:

(a) a support frame;

(b) a rotatable shaft supported and fixed to the frame at one or more rotation bearings;

(c) a spool assembly having a center fixed on the rotatable shaft and comprising a winding drum; and (d) a length of lead line windable on the spool assembly, the length of lead line sufficient to allow the user to engage in said ambulatory motion for a plurality of strides away from the spool assembly, the length of lead line comprising a flat elongated strap having a loop at each end thereof, the loop at a first end for retention on the winding drum of the spool assembly and the loop at a second end for attachment to the user;

wherein drawing the length of lead line out from being wound on the spool assembly directs a first rotational motion of the rotatable shaft, and wherein releasing the length of lead line drawn out from the spool assembly allows for a second rotational motion opposite the first in a manner that rewinds the length of lead line on the spool assembly.

9. The apparatus of claim 8 further comprising a weight horn assembly positioned on the support frame, the weight horn assembly comprising a post for receiving and retaining at least one removable weight to increase the overall weight of the apparatus and thereby assist in preventing its lateral motion during use.

10. The apparatus of claim 8 further comprising a harness secured to the user and connected to a loose end of the length of lead line.

11. The apparatus of claim 8 further comprising a means for storing energy generated by the process of drawing the length of lead line out from the spool assembly.

12. The apparatus of claim 11 wherein the means for storing energy comprises a coil spring assembly having a center end fixed relative to the rotatable shaft and a peripheral end fixed relative to the support frame; and wherein drawing the length of lead line out from being wound on the spool assembly directs a first rotational motion of the rotatable shaft and winds the coil spring assembly.

* * * * *